United States Patent [19]

Hermanns

[11] 3,944,166

[45] Mar. 16, 1976

[54] PROCESS FOR COMPENSATING SHORT-TERM FLUCTUATIONS IN THREAD TENSION DURING FEEDING OF THREAD TO WINDING MACHINES AND THE LIKE

[75] Inventor: Peter Hermanns, Stommeln, Cologne, Germany

[73] Assignee: FMN Schuster & Co., Hurth-Efferen, Germany

[22] Filed: Nov. 7, 1973

[21] Appl. No.: 413,737

[30] Foreign Application Priority Data

Nov. 11, 1972 Germany ..... 2255443

[52] U.S. Cl. ..... 242/147 A; 57/34 B; 57/157 F; 242/43 R

[51] Int. Cl.[2] ..... B65H 59/10

[58] Field of Search ..... 242/147 R, 147 A, 43; 226/97; 57/34 R, 157 F, 34 B

[56] References Cited

UNITED STATES PATENTS

| | | | |
|---|---|---|---|
| 1,046,822 | 12/1912 | Madden | 242/147 A |
| 2,302,790 | 11/1942 | Modigliani | 226/97 X |
| 2,621,391 | 12/1952 | Hoffman et al. | 226/97 |
| 2,944,414 | 7/1960 | Malloy et al. | 242/147 R X |
| 3,022,566 | 2/1962 | Daniels et al. | 226/97 UX |
| 3,116,589 | 1/1964 | Edwards et al. | 57/157 F |
| 3,296,785 | 1/1967 | Hardy | 57/34 R |
| 3,309,752 | 3/1967 | Nuissl | 57/157 R X |
| 3,742,692 | 7/1973 | Bense | 57/157 F X |

*Primary Examiner*—Stanley N. Gilreath
*Attorney, Agent, or Firm*—Neil F. Markva

[57] ABSTRACT

A method and apparatus is provided for compensating short duration thread tension fluctuations during feed of thread to a textile machine. The method includes blowing a jet of fluid medium along the thread in a direction opposite to the direction of travel of the thread from a delivery zone to a thread takeup zone. The blown jet of fluid medium produces a deflection of the thread from its straight path to form a storage or reserve of the thread from which thread may be taken during short-term fluctuations. The apparatus includes various forms of a blower mechanism and control means for providing the necessary storage or reserve of thread along its path of travel.

5 Claims, 8 Drawing Figures

FIG. 2
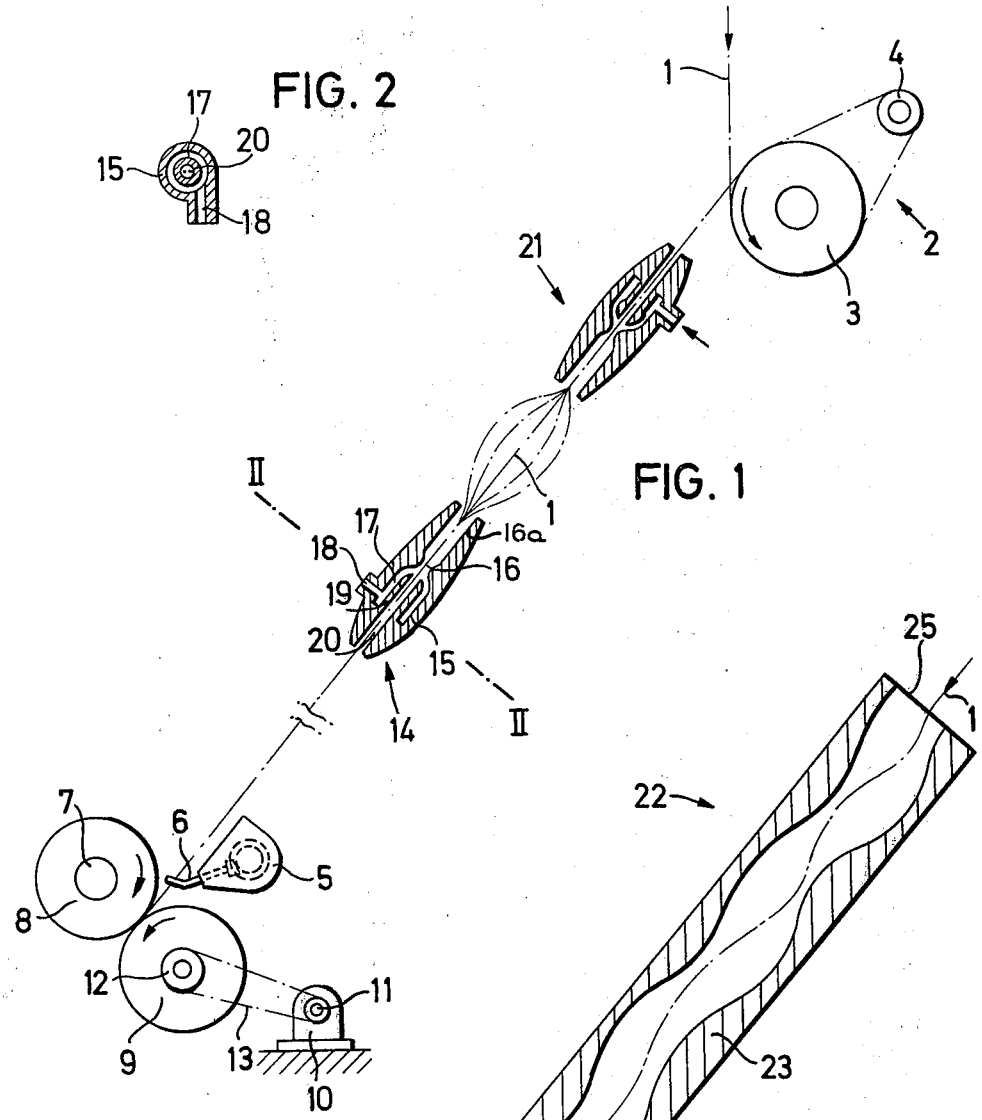
FIG. 1
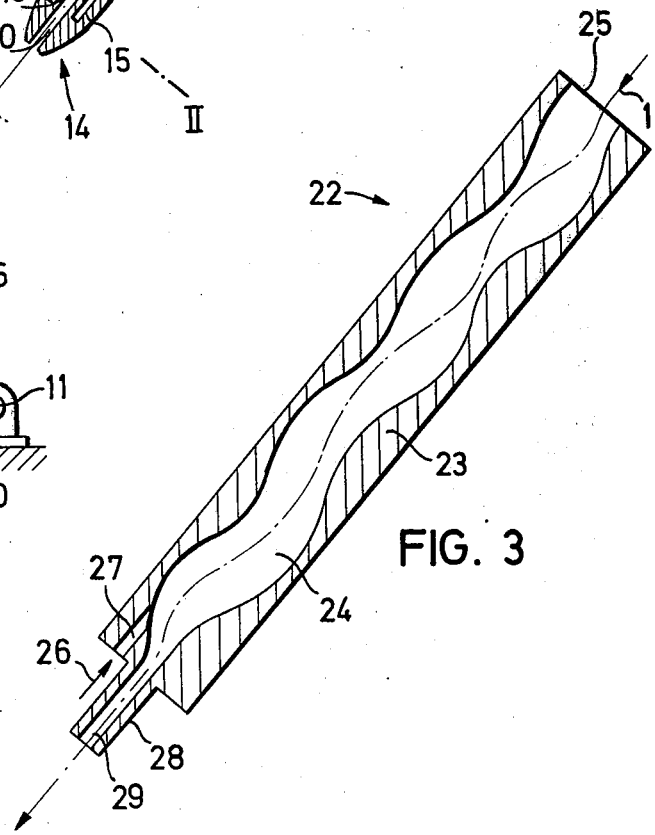
FIG. 3

PROCESS FOR COMPENSATING SHORT-TERM FLUCTUATIONS IN THREAD TENSION DURING FEEDING OF THREAD TO WINDING MACHINES AND THE LIKE

BACKGROUND OF THE INVENTION

In a winding machine such as a cross bobbin winding machine, thread is deposited in a spiral configuration during winding onto a spool. A thread guide reciprocates back and forth along the length of the spool in an alternating left and right hand spiral with the pitch of the spiral reversing at the spool end. Because of this, the winding speed of the thread is not equal to the peripheral speed of the rotating spool but equals the peripheral speed divided by the co-sine of the pitch angle.

The reversal of the pitch direction does not occur in zero time but in a finite time dependent on the type of thread guide being used. The thread is not deposited at the spool ends in a sharp reversing angle, but in a reversing arc determined by the mechanics of the thread guide elements. Consequently, the pitch angle changes to zero in a finite time and then increases again in the opposite direction to its maximum value. Because of this, the thread speed during the back and forth movement of the thread constantly changes. Thus, when the spool rotates at a constant peripheral speed, the thread speed is not constant.

A further cause of non-constant thread speed is the influence of the so-called thread triangle. The thread triangle is formed by both the reversing points of the thread guide and an upper fixed point which generally lies above the center of the traverse path of the thread guide along the base of the thread triangle. The upper fixed point is spaced from the traverse path of the thread guide by a distance which can be considerable and is generally from two to four times the length of the traverse stroke path. When the thread guide moves from the middle of the traverse path to one distal end thereof, the distance between the thread guide and the fixed point increases. With a constantly rotating spool taking up the thread, this alteration or change in distance causes an increase in the thread speed. When the thread moves in the opposite direction toward the middle of the traverse path, the thread speed decreases because of the decreasing distance between the thread guide and the fixed point. Thus, with a constantly rotating spool, the thread speed is not constant.

Both of these speed alterations are unavoidable and have undesirable effects on the direct winding of threads which are delivered at a takeup zone at constant speed from a processing machine. A medial thread winding speed and thread winding tension may be selected by adjusting the ratio of the winding speed to the delivery speed in a direct winding process. However, because of the constantly changing speed of thread during the winding procedure, irregular thread tension occurs. The resultant differences in thread tension can reach values which can drop from the medial tension to zero and the tension peaks can come to two to five times the value of the medial tension.

It is known to equalize the constant alteration in thread tension by passing the thread over a guide pulley as it runs from the fixed point to the traversing thread guide. The guide pulley is mounted on a pivoting arm and the wrapping angle of the thread is approximately 180°. Such a pivoting arm is also called a jumper arm.

The pivoting arm is intended to regulate the thread tension to a constant value as a result of its continual pivoting by means of a counter force. Because the pivoting arm is an inertial element, the regulating facility is difficult and sluggish.

Attempts have been made to replace the guide pulley by having the thread blown in a reverse manner by a stream of fluid medium. In this attempt, the blower device is located at the end of the arm and forms the return momentum for the deflection of the arm. It is necessary to guide the thread around further turning units such as pins or the like on both sides of the blower device so that varying sizes of loops may be formed during the blowing operation. However, even in this case, the device is not free of inertia. Moreover, such a device is bulky because additional turning of the thread in the thread run must be incorporated. In addition, the device is wasteful of energy. That is, a considerable volume of air is consumed because the thread loop must be maintained by a blown jet of fluid medium and a continuous air cushion must be maintained at a relatively high pressure.

PURPOSE OF THE INVENTION

The primary object of the invention is to maintain thread tension when a thread is fed to a thread takeup machine in a simple and inexpensive manner.

Another object of the invention is to provide a method and apparatus of compensating short-term fluctuations in thread tension while using a blown jet of fluid medium which causes a deflection in the traveling thread thereby producing a reserve or storage amount of thread along the path of travel.

SUMMARY OF THE INVENTION

As disclosed herein, thread is fed from a delivery mechanism at a constant speed to a processing machine such as a winding machine or the like. The thread extends freely along a linear path and is subjected to a blown jet directed along the thread in a direction opposite to the direction of travel for the thread. Such a blowing procedure along the longitudinal axis and in a direction opposite to the direction of travel produces an effect enabling a constant thread tension to be maintained. Such a blowing procedure causes the thread to move in a more or less vibratory fashion. That is, a fluttering movement occurs along the length of the thread causing the thread to be taken up within a relatively small deviation from the straight line of travel. The deviation of the thread represents a thread reserve which serves to maintain the regular thread tension during altering or changing thread speeds. That is, the thread reserve is decreased to a greater or lesser degree during operation of the thread takeup processing machines.

When the thread speed decreases, the deflection of the thread becomes larger and the thread reserve increases. When the thread speed increases, the thread reserve resulting from the thread vibration is correspondingly decreased without an increase in thread tension.

The apparatus made in accordance with this invention is used to effect the method as described hereinabove. The apparatus comprises a blower mechanism adapted to blow a jet of fluid medium along the moving thread in a direction opposite to the direction of travel for the thread. The blower mechanism may include a nozzle device having the form of an injector and including a thread passage and a fluid medium passage through which a blown jet of fluid medium is supplied longitudinally along the thread outside the nozzle device. The fluid medium passage may include an annular duct and an inlet means to the said annular duct. In a specific embodiment, the inlet means is disposed to tangentially introduce the fluid medium into the annular duct. In this way, the stream of fluid medium emerges from a funnel-shaped outlet in a swirling movement to effect a twisting or rifled effect in the moving thread. Such a twisting effect reinforces the provision of vibrations in the thread by a considerable degree. The blower mechanism which directs the jet of fluid medium in a direction opposite to the direction of thread travel serves as a counter flow brake on the thread.

In another embodiment, the blower mechanism includes two nozzle devices of the type described hereinabove. The nozzle devices are spaced apart with respect to each other along the length of the thread with the jet outlet ends being directed toward each other. This relationship between the nozzle devices considerably reinforces the formation of vibrations in the thread between the devices. A so-called thread balloon is formed between the devices and is maintained at different sizes in dependence upon the intensity of the blowing fluid medium. As described, the devices are spaced apart by a distance effective to have the jets of fluid medium directed therefrom to cooperate with respect to each other to form the appropriate thread deflection forming a thread reserve.

The thread reserve may also have a deflecting configuration established by transverse vibration thereof instead of producing a so-called thread balloon effect. In this embodiment, the blower mechanism includes a nozzle device having a casing with a duct extending longitudinally thereof and being open at each end to form a thread passage therethrough. The duct includes a deflecting zone wherein the inside surface of the casing has an undulating configuration to cause the jet of fluid medium to change directions therein thereby causing a deflection of the thread extending through the thread passage. A blower feed hole is disposed eccentrically with respect to the thread outlet opening which has a passage of smaller diameter than the deflecting zone within the duct.

In a further embodiment of the invention, the blower mechanism is offset with respect to the direction of delivery from the delivery mechanism to form a loop in the thread between the delivery mechanism and the blower mechanism. Thus, the thread can hang in a greater or lesser bight thereby providing the desired thread reserve.

Air may be used at a predetermined pressure as a fluid medium in the jet blowing device. However, other fluid mediums such as steam or liquid may also be used.

BRIEF DESCRIPTION OF THE DRAWINGS

Other objects of this invention will appear in the following description and appended claims, reference being made to the accompanying drawings forming a part of the specification wherein like reference characters designate corresponding parts in the several views.

FIG. 1 is a side elevational view partially in section of an apparatus for maintaining constant thread tension in accordance with this invention, FIG. 2 is a cross-sectional view along line II—II of FIG. 1, FIG. 3 is a cross-sectional view of another embodiment of an apparatus made in accordance with this invention.

DESCRIPTION OF SPECIFIC EMBODIMENTS

Figure 4:
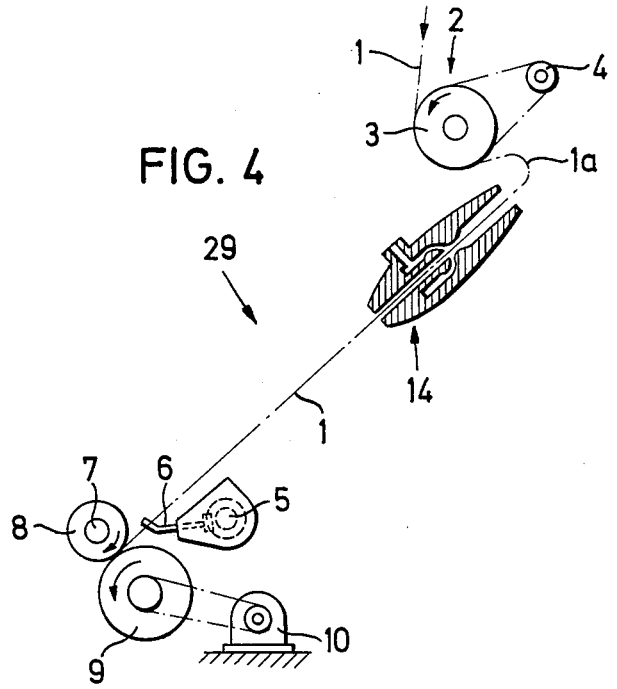
FIG. 4 is a side elevational view partially in section of an apparatus functioning in accordance with the invention.

More specifically, referring to FIG. 1, thread 1 passes from a delivery mechanism 2 which comprises rollers 3 and 4 to a traversing device 5 having thread guide 6 which is continuously moved back and forth along a spool core 7 by a mechanism such as a reverse thread roller. Thread 1 is wound onto spool core 7 to form a thread package 8. Friction roller 9 rotates the spool core 7 and friction package 8. The friction roller 9 is driven at a constant rotational speed by a motor 10 by means of pulleys 11 and 12 and a drive belt 13. The delivery mechanism 2 and the friction roller 9 are driven at a constant r.p.m. ratio. The peripheral speed of the package 8 taking up the thread 1 is independent of the spool diameter and thus is always in the same ratio to the speed of the driven friction roller 9. This peripheral speed relationship is maintained because of the type of friction roller drive being used.

A blower mechanism comprising nozzles, generally designated 14 and 21, are used to maintain constant thread tension in the thread 1 which is freely moving in a straight line. Nozzle 14 includes a casing 15 having a throat 16 adjacent one end thereof. Casing 15 also includes an annular duct 17 connected to a feed duct 18 through which fluid medium is blown. A shell-shaped portion 19 has an axial passage 20 disposed in the interior of casing 15. Thread 1 runs through the throat 16 and passage 20. The annular duct 17 opens into the throat 16 located at the open mouth end **16*a* of nozzle 14. The construction of nozzle 21 is identical to nozzle 14 and the mouth ends of the nozzles 14 and 21 face each other at laterally spaced locations along the continuously running thread 1. A straight path zone for the thread 1 is defined between the laterally spaced nozzles 14 and 21** disposed at opposite ends of the zone.

Fluid medium is blown into the feed duct 18 and out of the open mouth ends so that a jet of fluid medium is blown in a direction from one nozzle to the other nozzle.

Nozzle 21 with its corresponding jet of fluid medium insures that the thread 1 is drawn from the delivery mechanism 2 particularly when there is a speed minimum at the winding point. The other blower device or nozzle 14 has its corresponding jet of fluid medium operating in the direction opposite to the direction of travel of the thread thereby producing a braking effect. Consequently, the thread 1 is caused to deviate a certain extend from its extended straight position between the nozzles 14 and 21. This method of blowing produces a ballooning effect in the thread 1 between the open mouth ends of the nozzles 14 and 21 as shown in FIG. 1. Thus, there is formed a predetermined thread reserve so that the thread 1 runs at a predetermined tension even when there is a minimum speed at the winding point. The braking or ballooning effect on the thread 1 can be adjusted by altering the pressure of the blown fluid medium in nozzles 14 and 21.

As shown in FIG. 2, the fluid medium input jet is applied to the annular duct 17 in a slightly tangential and not radial configuration. The feed duct 18 is oriented slightly obliquely to the longitudinal axis of the nozzle instead of being perpendicular thereto. The tangential introduction of the blown jet of fluid medium produces a rifled or twisting motion therein as it emerges from the funnel-shaped outlets of the duct 17 into the throat 16. The rifled or twisting motion reinforces the deflection of the thread 1 along the free run to enhance the ballooning effect.

Thread 1 emerges from nozzle 21 at a constant speed as predetermined by the delivery mechanism 2. Thread 1 is withdrawn from nozzle 14 at a speed that is not constant because of the traversing of the thread guide 6 along the length of the thread package 8 and the thread triangle formed as a result of the operation of the winding device. Consequently, the ballooning portion of thread 1 located between blower devices or nozzles 21 and 14 changes its length. The ballooning thread portion is moved in a swirling motion by the blown fluid medium emerging from the open mouth ends of the nozzles 14 and 21. The production of the thread reserve within the thread balloon enables the thread emerging from blower device 14 and running onto spool 8 to have a constant thread tension despite differing thread speeds.

A blowing device, generally designated 22, shown in FIG. 3 imparts a transverse vibration to the thread 1. Casing 23 includes a duct 24 which extends in an undulating manner along casing 23. Inlet end 25 of duct 24 is entirely open. A fluid medium supply 26 such as air is introduced through a hole 27 located at the outlet end of casing 23. A nozzle 28 is disposed at the outlet end of casing 23 and it has a passage 29 with a diameter smaller than that of duct 24.

The overall length of corrugated duct 24 must be large enough for the difference in thread length resulting from the traversing of the thread guide and the thread triangle to correspond to additional thread length resulting from the deflection of thread 1 within duct 24. In this way, sufficient storage of thread 1 is achieved in device 22 in order to provide sufficient amount of thread reserve. The thread reserve in the device 22 is sufficient in the same manner as the size of the thread balloon formed in the embodiment of FIG. 1 between nozzles 14 and 21. It is contemplated that the blowing device 22 may be provided as a substitute for either the nozzle 14 by itself or the combination of nozzles 14 and 21.

In the arrangement generally designated 29 as shown in FIG. 4, there is only one nozzle 14 whose air jet produces no swirling effect in the thread 1. The longitudinal axis of the nozzle 14 is offset from the direction of delivery from the delivery mechanism 2. This makes it possible for thread 1 to form a loop 1*a* by means of the nozzle 14 and the property of the delivery mechanism which is to carry the thread 1 only slightly in the direction of travel. In this embodiment, loop 1*a* forms the thread reserve entirely in the open. The size of loop 1*a* is a measure of the thread reserve required in dependence on the thread triangle and the reversing traverse path of the thread guide along the reverse thread roller.

Figure 5:
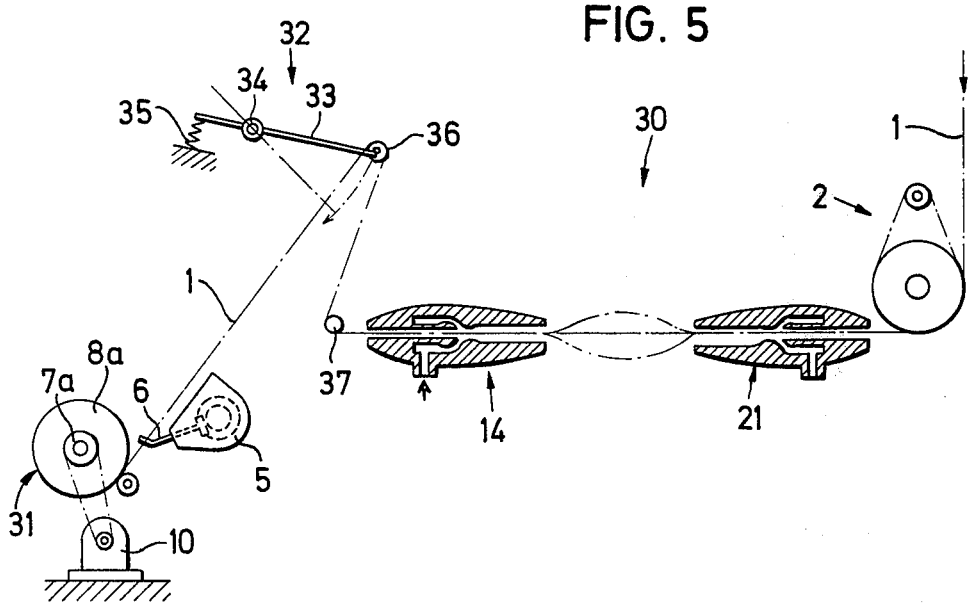
FIG. 5 is a diagrammatic elevational view partially in section of a further embodiment made in accordance with this invention.

In the arrangement generally designated 30 as shown in FIG. 5, spool 7*a* is driven directly from the motor 10 in the winding machine, generally designated 31. Consequently, the peripheral speed of spool 7*a* results in a variation in the r.p.m. as the diameter of the thread package 8*a* increases. Even in such a spindle-driven winding machine 31, the nozzle 14 or the combination of nozzles 14 and 21 may be incorporated to provide a certain thread reserve in a very simple way. However, a further control device, generally designated 32, is provided to control the winding speed of the thread 1. The control device 32 includes an arm 33 pivotally mounted intermediate its ends at axis 34. A return spring 35 is attached to one end of the arm 33 and a guide pin 36 is disposed at the other or free end of arm 33. A further guide pin 37 is associated with the guide pin 36 at a spaced distance therefrom as shown in the drawing. By means of the deflection of arm 33, the r.p.m. of the spindle 7*a* is controlled via the motor 10 for a constant peripheral speed of the thread package 8*a*. The speed alterations during one back and forth or to and fro movement of thread guide 6 are correspondingly equalized in order to maintais the thread tension constant by the action of nozzles 14 and 21.

Figure 6:
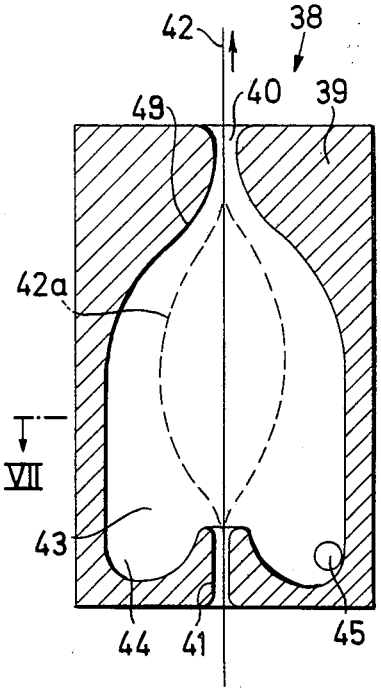
FIG. 6 is a cross-sectional view of a still further embodiment of an apparatus made in accordance with this invention.
Figure 8:
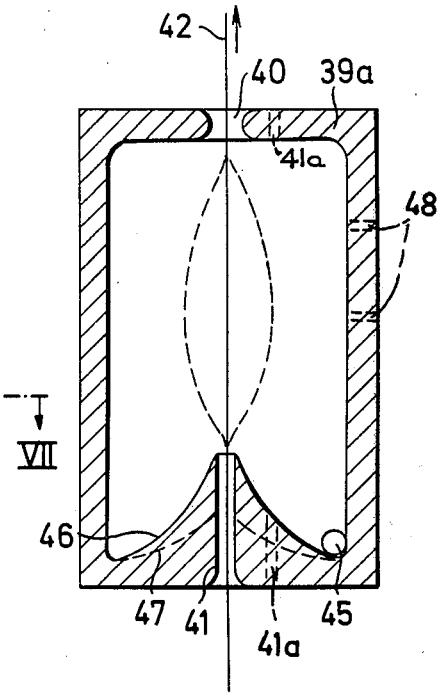
FIG. 8 is a longitudinal cross-sectional view of a still further embodiment of an apparatus made in accordance with this invention.
Figure 7:
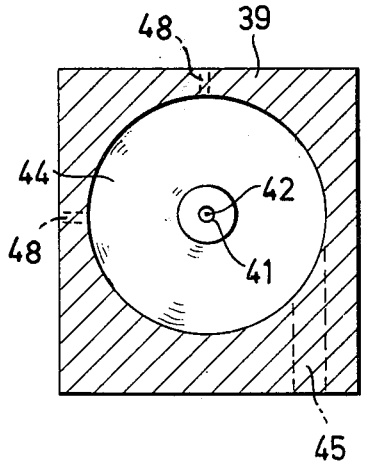
FIG. 7 is a cross-sectional view along line VII-VII of FIG. 6.

Each of the devices shown in FIGS. 6 through 8 serves to form a thread reserve in the running thread in the form of a thread balloon by means of a blown jet of fluid medium. The device, generally designated 38, includes a casing 39 having central openings 40 and 41 through which the thread 42 extends and runs in a continuous manner. Opening 40 gradually expands somewhat conically along surface 49 into the inner space 43 which is cylindrical in form. An annular trough 44 is located around the opening 41. A tangential duct 45 opens into the annular trough 44 to supply a blown fluid medium. In this particular embodiment, air is the fluid medium. The flow of air blown into the device through duct 45 is in a direction opposite to the movement of thread 42. The air will predominantly emerge at the opening 40 thereby exerting a braking effect on thread 42. Radial air outlet holes 48 as shown in phantom in FIG. 7 may be provided to reduce such a braking effect. The blown air adopts a swirling movement within the casing 39. Consequently, thread 42 is deflected in the form of a thread balloon 42*a* having varying size.

Casing 39*a* shown in the embodiment of FIG. 8, is cylindrical at the passage 40 for thread 42. The casing end wall is generally conical around the thread passage 41 as shown at profiles 46 or 47. The thread passage may also be arranged in accordance with the openings 41*a* as shown in FIG. 8. The thread balloon forms when the blown jet of fluid medium is provided through duct 45. The thread reserve in the thread balloon equalizes short duration fluctuations in thread tension in the associated winding machines. Blower devices or nozzles having a closed casing have the advantage that a smaller amount of air is required for the blown jet.

Little air is used in providing the thread reserve. This is of considerable importance during continuous operation of winding machines and is extremely economical. The casing can be made of transparent material such as glass or artificial glass. This provides the advantage that the size of the thread balloon can be monitored at any time. The intensity of the blown jet is accordingly easily regulated.

The described devices combine several advantages of an important type. Not only is control of thread tension and compensation of fluctuations in thread tension during a winding process achieved, but turbulence in the thread is achieved by the blown jet. This is particularly true with synthetic threads which are made up of individual fibers. In this case, the blown jet twists the individual fibers together so that twisting or smoothing of the thread can be eliminated. The described devices can be incorporated without difficulty in the thread run in front of the so-called thread triangle in existing winding machines. This provides compensation of short duration fluctuations in thread tension in a simple manner in winding machines already in existence.

ADVANTAGES OF THE INVENTION

The method carried out in accordance with this invention is simple and effective and entirely eliminates problems associated with inertia as in the prior art mechanisms. There is no looping of the thread by 90° or more required for the method of this invention. Additional frictional points are eliminated because guide units formerly used have been eliminated. The structural arrangement of the apparatus is compact and economical with respect to the consumption of energy. Further, the apparatus of the invention may be disposed along a straight portion of any thread being wound. In addition, the consumption of fluid medium is maintained at a minimum because there is no necessity for forming an air cushion in conjunction with this operation.

While the process and apparatus for compensating short-term fluctuations in thread tension during feeding of thread to winding machines and the like has been shown and described in detail, it is obvious that this invention is not to be considered as being limited to the exact form disclosed, and that changes in detail and construction may be made therein within the scope of the invention, without departing from the spirit thereof.

Having thus set forth and disclosed the nature of this invention, what is claimed is:

1. A method of compensating for short term fluctuations in thread tension during feeding of a thread to a working station that demands a varying amount of thread length during operation, said method comprising:

a. supplying thread to run freely along a straight path zone at a constant speed from a delivery zone, b. said straight path zone having a downstream end and an upstream end, c. blowing a first jet of fluid medium along the thread from the downstream end in a direction opposite to the direction of travel of the thread, and d. blowing a second jet of fluid medium along the thread from the upstream end toward said first jet, e. said blowing jets of fluid medium being effective to produce a reserve supply of thread within the straight path zone by causing a thread deflection away from the straight path.

2. A method as defined in claim 1 wherein a thread winding machine having a thread guide device reciprocating along the length of a reverse thread roller is provided and the blowing of said first and second jets is effected between the delivery zone and the reciprocating thread guide device.

3. A method as defined in claim 1 further including causing turbulence in the blown jets of fluid medium to cause deflections in the straight path zone traveled by said thread.

4. A method as defined in claim 1 wherein said blown fluid medium is steam or a liquid.

5. A method of delivering thread to a thread package, comprising:

a. supplying thread to run freely along a straight path zone at a constant speed from a delivery supply zone, b. said straight path zone having a downstream end and an upstream end, c. blowing a first jet of fluid medium along the thread from the downstream end in a direction opposite to the direction of travel of the thread, and d. blowing a second jet of fluid medium along the thread from the upstream end toward said first jet, e. said blowing jets of fluid medium being effective to produce a reserve supply of thread within the straight path zone by causing a thread deflection away from the straight path, f. reciprocating a thread guide device along the length of a reverse thread roller rotatably mounted adjacent the thread package, and g. directing the thread from the straight path zone through said thread guide device and onto the thread package.

* * * * *